US005093217A

United States Patent [19]

Datta et al.

[11] Patent Number: 5,093,217

[45] Date of Patent: Mar. 3, 1992

[54] APPARATUS AND METHOD FOR MANUFACTURING A SCREEN ASSEMBLY FOR A CRT UTILIZING A GRID-DEVELOPING ELECTRODE

[75] Inventors: Pabitra Datta, West Windsor Township, Mercer County; Randall E. McCoy, McConnellsburg, Pa.; Ronald N. Friel, Hamilton Township, Mercer County; John A. van Raalte, Princeton; Wilber C. Stewart, Hightstown, all of N.J.

[73] Assignee: RCA Thomson Licensing Corporation, Princeton, N.J.

[21] Appl. No.: 420,062

[22] Filed: Oct. 11, 1989

[51] Int. Cl.[5] ..... G03C 5/00; G03G 13/06

[52] U.S. Cl. ..... 430/28; 430/23; 430/103

[58] Field of Search ..... 430/23, 28, 103

[56] References Cited

U.S. PATENT DOCUMENTS

| | | | |
|---|---|---|---|
| 2,777,418 | 1/1957 | Gundlach | 118/51 |
| 2,784,109 | 3/1957 | Walkup | 117/17.5 |
| 2,817,598 | 12/1957 | Hayford | 117/17.5 |
| 2,842,456 | 7/1958 | Carlson | 117/17.5 |
| 3,475,169 | 10/1969 | Lange | 96/1 |
| 3,640,246 | 2/1972 | Jeromin et al. | 118/629 |
| 4,076,857 | 2/1978 | Kasper et al. | 427/18 |
| 4,267,450 | 5/1981 | Lange | 430/103 X |
| 4,583,489 | 4/1986 | Thourson et al. | 430/126 X |
| 4,860,600 | 9/1989 | Hays et al. | 430/120 X |
| 4,921,767 | 5/1990 | Datta et al. | 430/23 |

OTHER PUBLICATIONS

R. E. Rayford and W. E. Bixby, (1955) 6 Reversal Development of Continuous-Tone Xerographic Images, Photographic Engineering, 173, vol. 6, No. 3.

R. M. Schaffert, Electrophotography, § 2.5.1 (1966).

*Primary Examiner*—Marion E. McCamish

*Assistant Examiner*—S. Crossan

*Attorney, Agent, or Firm*—Joseph S. Tripoli; Dennis H. Irlbeck; Vincent J. Coughlin, Jr.

[57] ABSTRACT

An apparatus for electrophotographically manufacturing a luminescent screen assembly on a substrate for use within a CRT includes a developer for developing a photoconductive layer, having a latent image thereon, with a dry-powdered, triboelectrially-charged screen structure materials. The photoconductive layer overlies a conductive layer in contact with the substrate. A grid-developing electrode is located at a distance from the photoconductive layer that is large relative to the smallest dimension of the latent image. The electrode is biased with a suitable potential to influence the deposition of the charged screen structure materials onto the latent image on the photoconductive layer. A method for electrophotographically manufacturing the screen assembly utilizing the grid-developing electrode is also disclosed.

3 Claims, 5 Drawing Sheets

DEPOSIT
34
32
18

D. C. Volts
36
CHARGE
34
32
18

38
40
25
EXPOSE
34
32
18

A
Phosphors
or
Black Matrix
DEVELOP
18
32
34
44
42

23
FIX
34
32
18

APPARATUS AND METHOD FOR MANUFACTURING A SCREEN ASSEMBLY FOR A CRT UTILIZING A GRID-DEVELOPING ELECTRODE

The present invention relates to an apparatus and method for electrophotographically manufacturing a screen assembly, and more particularly to a grid-developing electrode for manufacturing a screen assembly for a color cathode-ray tube (CRT) using dry-powdered, triboelectrically-charged screen structure materials.

BACKGROUND OF THE INVENTION

A conventional shadow-mask-type CRT comprises an evacuated envelope having therein a viewing screen comprising an array of phosphor elements of three different emission colors arranged in a cyclic order, means for producing three convergent electron beams directed towards the screen, and a color selection structure or shadow mask comprising a thin multi-apertured sheet of metal precisely disposed between the screen and the beam-producing means. The apertured metal sheet shadows the screen, and the differences in incidence angles permit the transmitted portions of each beam to selectively excite only phosphor elements of the desired emission color. A matrix of light-absorptive material surrounds the phosphor elements.

U.S. Pat. No. 3,475,169 issued to H. G. Lange on Oct. 28, 1969 discloses a process for electrophotographically screening color cathode-ray tubes. The inner surface of the faceplate of the CRT is coated with a volatilizable conductive material and then overcoated with a layer of volatilizable photoconductive material. The photoconductive layer is then uniformly charged, selectively exposed with light through the shadow mask to establish a latent charge image, and developed using a high molecular weight carrier liquid bearing, in suspension, a quantity of phosphor particles of a given emissive color that are selectively deposited onto suitably charged areas of the photoconductive layer. The charging, exposing and deposition processes are repeated for each of the three color-emissive phosphors, i.e., green, blue, and red, phosphors of the screen.

An improvement in electrophotographic screening is described in U.S. Pat. No. 4,921,767, issued to P. Datta et al. on May 1, 1990, wherein the method thereof uses dry-powdered, triboelectrically-charged screen structure materials having at least a surface charge control agent thereon to control the triboelectrical charging of the materials. Such a method decreases manufacturing time and cost, because fewer steps are required for "dry-processing" of both the matrix and phosphor materials. A drawback of the described method is that some cross-contamination or background deposition may occur, because of electrostatic field variations near the photoconductor which do not effectively repel all the positively charged phosphor particles from selected regions of the photoconductor as described below.

Accordingly, a need exists for a means of electrophotographically manufacturing screen assemblies using dry-powdered, triboelectrically-charged phosphor materials, without cross-contamination of the different color-emitting materials.

SUMMARY OF THE INVENTION

An apparatus for electrophotographically manufacturing a luminescent screen assembly on a substrate for use within a CRT includes means for developing a latent image formed on a photoconductive layer using a dry-powdered, triboelectrically-charged screen structure material. The photoconductive layer overlies a conductive layer in contact with the substrate. A novel grid-developing electrode is spaced from the photoconductive layer by a distance that is large relative to the smallest dimension of the latent image. The electrode is biased with a suitable potential to influence the deposition of the charged screen structure material onto the charged photoconductive layer. A method for electrophotographically manufacturing the screen assembly utilizes the grid-developing electrode.

DETAILED DESCRIPTION OF THE PREFERRED EMBODIMENT

Figure 1:
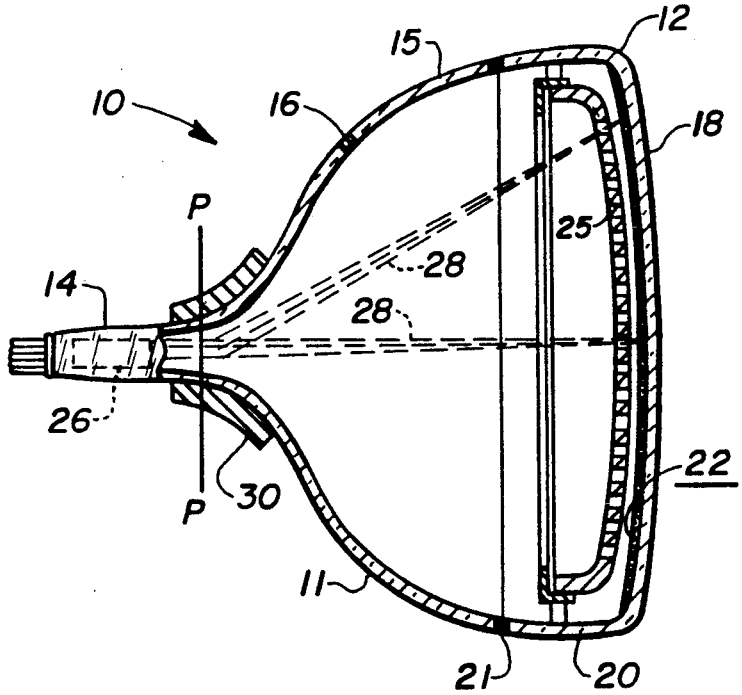
FIG. 1 is a plan view partially in axial section of a color cathode-ray tube made according to the present invention.
Figure 2:
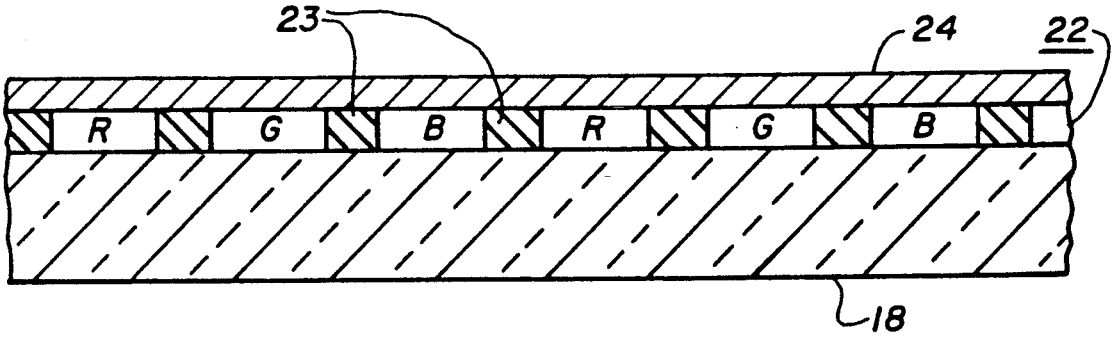
FIG. 2 is a section of a screen assembly of the tube shown in FIG. 1.

FIG. 1 shows a color CRT 10 having a glass envelope 11 comprising a rectangular faceplate panel 12 and a tubular neck 14 connected by a rectangular funnel 15. The funnel 15 has an internal conductive coating (not shown) that contacts an anode button 16 and extends into the neck 14. The panel 12 comprises a viewing faceplate or substrate 18 and a peripheral flange or sidewall 20, which is sealed to the funnel 15 by a glass frit 21. A three color phosphor screen 22 is carried on the inner surface of the faceplate 18. The screen 22, shown in FIG. 2, preferably is a line screen which includes a multiplicity of screen elements comprised of red-emitting, green-emitting and blue-emitting phosphor stripes R, G, and B, respectively, arranged in color groups or picture elements of three stripes or triads in a cyclic order and extending in a direction which is generally normal to the plane in which the electron beams are generated. In the normal viewing position for this embodiment, the phosphor stripes extend in the vertical direction. Preferably, the phosphor stripes are separated from each other by a light-absorptive matrix material 23 as is known in the art. Alternatively, the screen can be a dot screen. A thin conductive layer 24, preferably of aluminum, overlies the screen 22 and provides a means for applying a uniform potential to the screen as well as for reflecting light, emitted from the phosphor elements, through the faceplate 18. The screen 22 and the overlying aluminum layer 24 comprise a screen assembly.

Returning to FIG. 1, a multi-apertured color selection electrode or shadow mask 25 is removably mounted, by conventional means, in predetermined spaced relation to the screen assembly. An electron gun 26, shown schematically by the dashed lines in FIG. 1, is centrally mounted within the neck 14, to generate and direct three electron beams 28 along convergent paths through the apertures in the mask 25 to the screen 22. The gun 26 may, for example, comprise a bi-potential electron gun of the type described in U.S. Pat. No. 4,620,133, issued to A. M. Morrell et al. on Oct. 28, 1986, or any other suitable gun.

The tube 10 is designed to be used with an external magnetic deflection yoke, such as yoke 30, located in the region of the funnel-to-neck junction. When activated, the yoke 30 subjects the three beams 28 to magnetic fields which cause the beams to scan horizontally and vertically in a rectangular raster over the screen 22. The initial plane of deflection (at zero deflection) is shown by the line P—P in FIG. 1 at about the middle of the yoke 30. For simplicity, the actual curvatures of the deflection beam paths in the deflection zone are not shown.

The screen 22 is manufactured by an electrophotographic process that is described in the above cited U.S. Pat. No. 4,921,767, and schematically represented in FIGS. 3*a* through 3*e*.

Figures 3A, 3B, 3C, 3D, 3E:
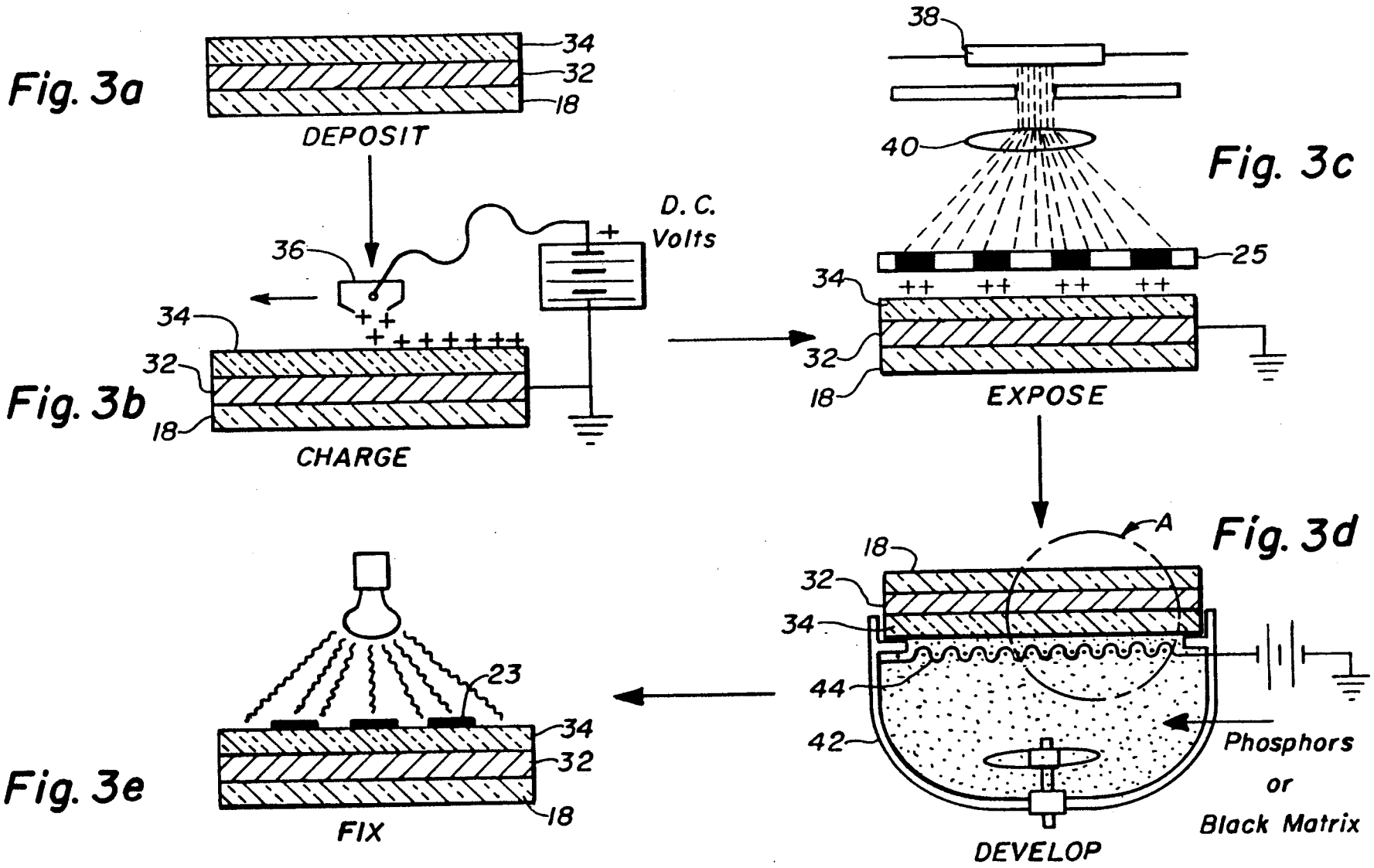
FIG. 3*a* shows a portion of a CRT faceplate having a conductive layer and a photoconductive layer thereon.
FIG. 3*b* shows the charging of the photoconductive layer on the CRT faceplate.
FIG. 3*c* shows the CRT faceplate and a portion of a shadow mask during a subsequent exposure step in the screen manufacturing process.
FIG. 3*d* shows the CRT faceplate and a novel grid-developing electrode during a developing
FIG. 3*e* shows the partially completed CRT faceplate during a later fixing step in the screen manufacturing process.

A photoconductive layer 34 overlying a conductive layer 32 is charged in a dark environment by a conventional positive corona discharge apparatus 36, schematically shown in FIG. 3*b*, which moves across the layer 34 and charges it within the range of +200 to +700 volts, although +200 to +500 volts is preferred. The shadow mask 25 is inserted into the panel 12 and the positively charged photoconductor is exposed, through the shadow mask, to the light from a xenon flash lamp 38 disposed within a conventional three-in-one lighthouse (represented by lens 40 in FIG. 3*c*). After each exposure, the lamp is moved to a different position to duplicate the incident angle of the electron beam from the electron gun. Three exposures are required, from three different lamp positions, to establish a latent charge distribution or image on the photoconductive layer 34, i.e., to discharge the areas of the photoconductor where the light-emitting phosphors subsequently will be deposited to form the screen. Such exposed areas of the latent image are typically about 0.20 by 290 mm for a 19 V screen and about 0.24 by 470 mm for a 31 V screen.

Figure 4:
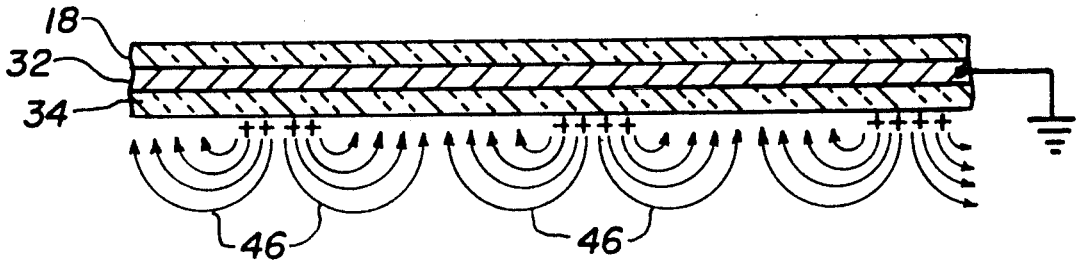
FIG. 4 shows the orientation of the electric field lines from a charged portion of the photoconductive layer on the CRT faceplate during one step in a screen manufacturing process when the novel grid-developing electrode is not utilized.

When there are no other charged materials or conducting electrodes in proximity to the photoconductive layer 34, the latent image from the three exposures produces a latent image field adjacent to the layer 34 represented by curving electric field lines 46, shown in FIG. 4, that extend from the unexposed positively charged regions to the exposed discharged regions. By convention, the direction of the field lines is the direction of the force experienced by a positively-charged particle; the force on a negatively-charged particle is in the reverse direction. The electric field lines 46 are substantially parallel to the photoconductive layer 34 over the regions where the surface charge varies most abruptly in position, and are substantially normal to the surface at those portions of the photoconductive layer 34 where the latent image has little spatial variation. When the lateral spacing, i.e., the width of the unexposed regions between the light-exposed regions, is in the range of 0.10 to 0.30 mm, typically about 0.25 mm, and the initial surface potential is in the preferred range of +200 to +500 volts, the peak magnitude of the latent image field at the photoconductive layer 34 is in the range of tens of kilovolts per centimeter (kV/cm). The three light exposures from three different lamp positions produce exposed regions that are typically several times wider than the unexposed regions; as a result, the normal field components at the surface are substantially stronger in the narrow unexposed regions than in the wider exposed regions. The magnitude of the latent image field near the surface of the photoconductive layer 34 diminishes rapidly with distance away from the surface, and is reduced to peak values of a few tenths of a kv/cm at a separation equivalent to about ¾ the period of the latent image pattern (about 0.19 mm).

After the exposure step of FIG. 3*c*, the shadow mask 25 is removed from the panel 12, and the panel is moved to a first developer 42 (FIG. 3*d*) containing suitably prepared dry-powdered particles of a light-absorptive black matrix screen structure material. The black matrix material may be triboelectrically-charged by the method described in above-cited U.S. Pat. No. 4,921,767.

The developer 42, shown in FIG. 3*d*, includes a novel grid-developing electrode 44, typically made of a conductive mesh having about 6 to 8 openings per cm, which is spaced from the photoconductive layer 34 to facilitate the development thereof as described below. While 6 to 8 openings per cm are preferred, 100 openings per cm have been used successfully.

The spacing of the electrode 44 from the photoconductive layer 34 should be at least twice the lateral period of the openings in the mesh so that the field created by the electrode 44 is sufficiently uniform. Additionally, the spacing should be great enough to provide a substantially uniform normal field component, as described below, beyond the range of the latent image field represented by electric field lines 46. Typical spacings between the layer 34 and the electrode 44 range from 0.5 to 4 cm, with 1 cm to 2 cm being preferred. Such spacings are large relative to the smallest dimension of the latent image produced on the layer 34. The electrode 44 is especially useful for developing both the black matrix and the phosphor patterns as described below.

Figure 5:
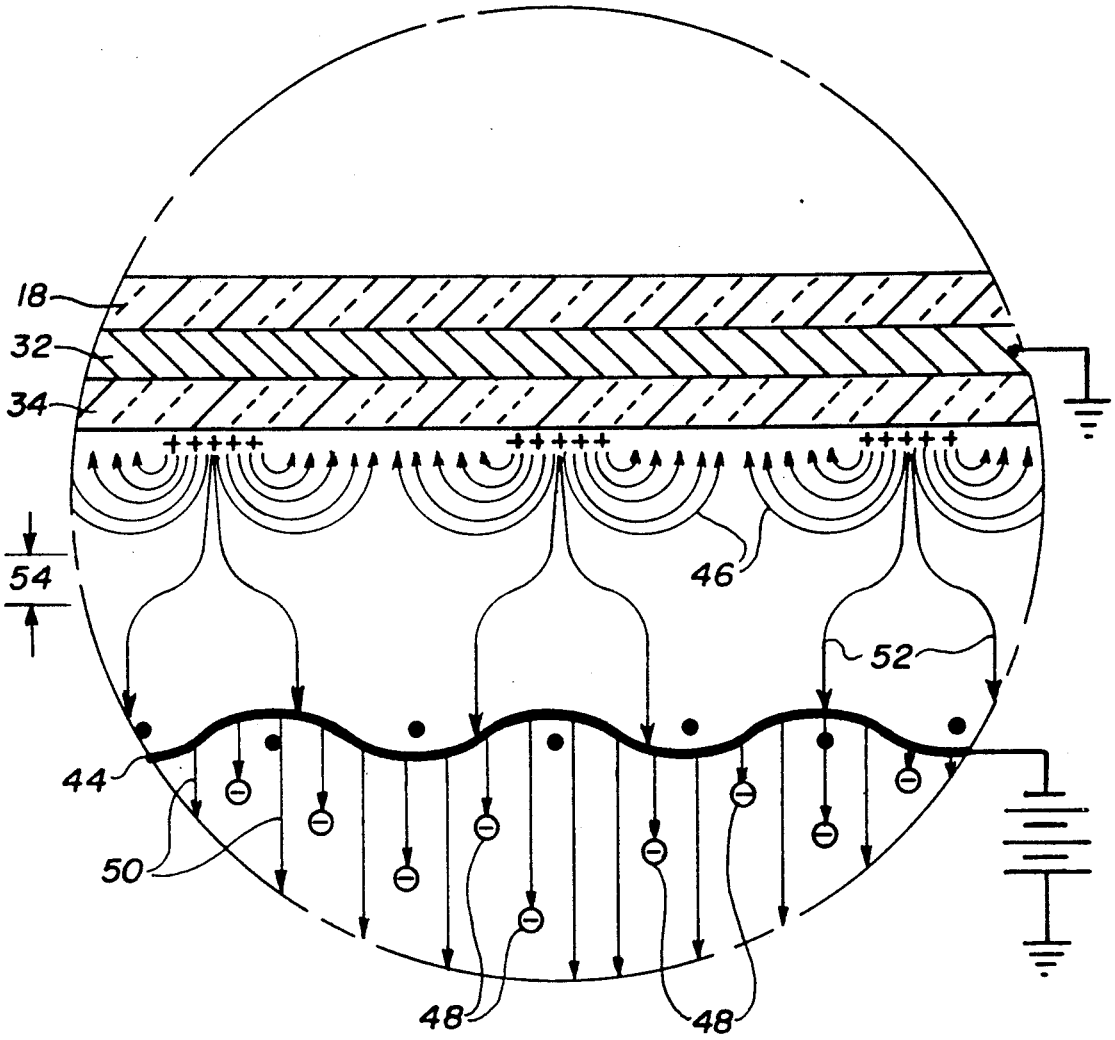
FIG. 5 shows portions of the CRT faceplate and the novel grid-developing electrode, which are within circle A of FIG. 3*d*, during a matrix developing step in the screen manufacturing process.

During development, negatively-charged matrix particles 48, shown in FIG. 5, are expelled into the volume adjacent to the grid-developing electrode 44. The resulting body of space charge creates a substantially uniform, normal electric space charge field component 50 outside the grid-developing electrode 44. This space-charge field component 50 is directed away from the photoconductive layer 34 and acts to propel the negatively-charged matrix particles 48 through the opposing drag forces of the ambient air toward the photoconductive layer 34. The magnitude of the space-charge field may range from a few tenths of a kV/cm to several kV/cm; it is governed by the geometry of the developer 42 and the physical properties of the negatively-charged matrix particles 48. In particular, the space-charge field strength is proportional to the flow rate with which the negatively-charged matrix particles 48 leave the developer 42, and is substantially independent of any potentials in the approximate range of zero to −2000 volts that might be applied to the grid-developing electrode 44. The purpose of the grid-developing electrode 44 is to establish a spatially uniform equipotential surface, controlled by an externally applied potential or bias voltage, near the photoconductive layer 34. By this means, the space-charge field lines 50 are terminated, and a separate, substantially uniform normal field component 52, in the volume between the photoconductive layer 34 and the grid-developing electrode 44, becomes proportional to the difference between the potential applied to the electrode 44 and the spatial average of the positive potential from the latent image on the layer 34, and becomes inversely proportional to the distance from the layer 34 to the electrode 44. This uniform field component 52 adds vectorially to the existing latent image field near the surface of the photoconductive layer 34, as shown in FIG. 5, producing a negligible degree of distortion to the field lines 46 of the latent image field. This negligible distortion does not, however, intensify the latent image field nor straighten the field lines 46 associated with the image field. The resultant electric field undergoes a transition in a narrow zone 54 located at a distance from the photoconductive layer 34 approximately equal to three-fourths of the repeat period of the latent image pattern (typically less than 1 mm). The grid-developing electrode 44 must be positioned beyond this distance for the proper operation of the developing process. At distances greater than the distance to the transition zone 54, the electrical force on the approaching negatively-charged matrix particles is dominated by the substantially uniform field component 52 controlled by the grid-developing electrode 44. At lesser distances, i.e., between the photoconductive layer 34 and the transition zone 54, the rapidly strengthening latent image field becomes dominant.

In the above cited, U.S. Pat. No. 4,921,767, in which no grid-developing electrode is used, the substantially uniform space-charge field from the body of negatively-charged matrix particles extends directly to the latent image field near the surface of the photoconductive layer 34. Fluctuations in the flow rate with which matrix material is expelled from the developer 42 produce correlated fluctuations in the magnitude of the space-charge field. When the space charge field is too strong, it may reverse the direction of the repelling component of the latent image field, in the unexposed region at the surface of the photoconductive layer 34, and thereby cause the particles to land at undesired, i.e., unexposed, locations on the photoconductive layer. A somewhat weaker space charge field does not reverse the repelling component of the latent image field, but may shift the location of the field transition zone too close to the photoconductive layer 34. When such a shift occurs, negatively-charged matrix particles with high mass density, high triboelectric charge and/or large size, may acquire enough momentum toward the photoconductive layer 34 to traverse the narrow space of repelling forces and thereby land at the above-described undesired locations. In the present invention, the grid-developing electrode 44 is located at a distance substantially beyond that of the transition zone 54, to provide a controlled, substantially uniform electric field component 52 beyond the range of the latent image field. Such a location for the grid-developing electrode 44 shields the latent image field, represented by field lines 46, from the effects of the space charge field 50 created by the space charge of the particles expelled by the developer 42. The bias voltage on the grid-developing electrode 44 may be adjusted, by taking into consideration the desired flow rate of material from the developer 42 and the physical properties of the negatively-charged matrix particles, to minimize the deposition of matrix particles on the undesired locations of the photoconductor. The potential applied to the grid-developing electrode 44 should be more negative than the spatial average of the potential from the latent image, in order that the substantially uniform field component 52, outside the transition zone 54, acts to attract the negatively-charged matrix particles 48 to the photoconductive layer 34. Useful values for the potential on the grid electrode 44 range from zero to about −2000 volts. If the uniform electric field component 52, established by the grid-developing electrode 44, is weaker than the electric field 50 from the body of space charge, the grid field cannot support a material flow rate as high as the rate at which negatively-charged matrix particles are expelled from the developer 42. Consequently, the grid-developing electrode 44 will collect a fraction of the negatively-charged matrix particles, while the remaining fraction will continue toward the photoconductive layer 34 at a lower flow rate commensurate with the reduced field intensity between the grid-developing electrode 44 and the photoconductive layer 34. Conversely, if the uniform electric field component 52 between the grid-developing electrode 44 and the photoconductive layer 34 is equal to or stronger than the electric field 50 of the space charge, few negatively-charged matrix particles 48 will be collected by the grid-developing electrode 44. The particles 48 will tend, instead, to pass through the openings of the grid-developing electrode 44 and to be accelerated to the new flow velocity associated with the higher electric field component 52. Negatively-charged matrix particles are propelled through the transition zone 54 and attracted to the positively-charged, unexposed area of the photoconductive layer 34 to form the matrix layer 23 by a process called direct development.

Infrared radiation may then be used, as shown in FIG. 3*e*, to fix the particles 48 of matrix material by melting or thermally bonding the polymer component of the matrix material to the photoconductive layer to form the matrix 23.

Figure 6:
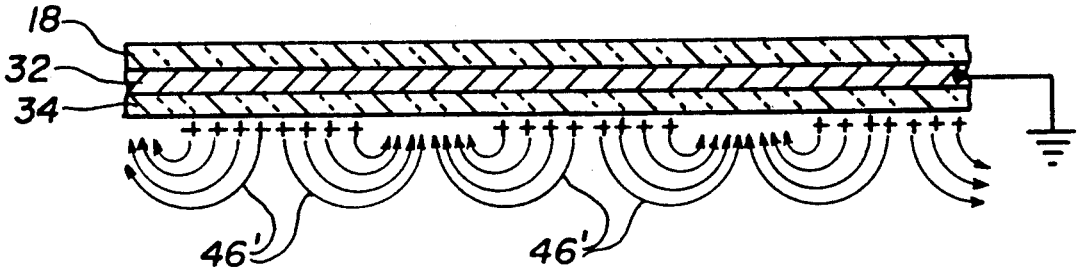
FIG. 6 shows the orientation of the electric field lines from a charged portion of the photoconductive layer on the CRT faceplate during a subsequent step in the screen manufacturing process when the grid-developing electrode is not utilized.

The photoconductive layer 34 containing the matrix 23 is uniformly recharged to a positive potential of about 200 to 500 volts for the application of the first of three color-emissive, dry-powdered phosphor screen structure materials. The shadow mask 25 is re-inserted into the panel 12 and selective areas of the photoconductive layer 34, corresponding to the locations where green-emitting phosphor material will be deposited, are exposed to visible light from a first location within the lighthouse 40 to selectively discharge the exposed areas. The first light location approximates the incidence angle of the green phosphor-impinging electron beam. When there are no other charged materials or conducting electrodes in proximity to the photoconductive layer 34, the latent image from the single exposure produces a latent image field represented by curving electric field lines 46,, shown in FIG. 6, that extend from the unexposed positively-charged regions to the exposed discharged regions. The electric field lines 46' are substantially parallel to the photoconductive layer 34 over the regions where the surface charge varies most abruptly in position, and they are substantially normal to the surface at those portions of the photoconductive layer 34 where the latent image has little spatial variation. When the lateral spacing between the light-exposed regions where green-emitting phosphor material will be deposited is in the range of 0.30 to 0.90 mm, typically 0.76 mm, and the initial surface potential is in the preferred range of +200 to +700 volts, the peak magnitude of the latent image field at the photoconductive layer 34 is in the range of tens of kilovolts per centimeter (kV/cm). Unlike the three superimposed light exposures from three lamp positions previously used for the black matrix pattern, the light exposure from a single lamp position produces exposed regions that are typically several times narrower than the unexposed regions; as a result, the normal field components at the surface are substantially stronger in the narrow exposed regions than in the wider unexposed regions. The magnitude of the electric field near the surface of the photoconductive layer 34 diminishes rapidly with distance away from the surface, and is reduced to a peak value of a few tenths of a kV/cm at a separation equivalent to about ¾ the period of the latent image pattern for the green-emitting phosphor locations.

After the exposure of the locations where the green-emitting phosphor will be deposited, the shadow mask 25 is removed from the panel 12 and the panel is moved to a second developer 42 having a grid-developing electrode 44 and containing suitably prepared dry-powdered particles of green-emitting phosphor. The phosphor particles are surface-treated with a suitable charge controlling material, as described in U.S. Pat. No. 4,921,727, issued to P. Datta et al. on May 1, 1990, and U.S. patent application Ser. No. 287,358, filed by P. Datta et al. on Dec. 21, 1988.

Figure 7:
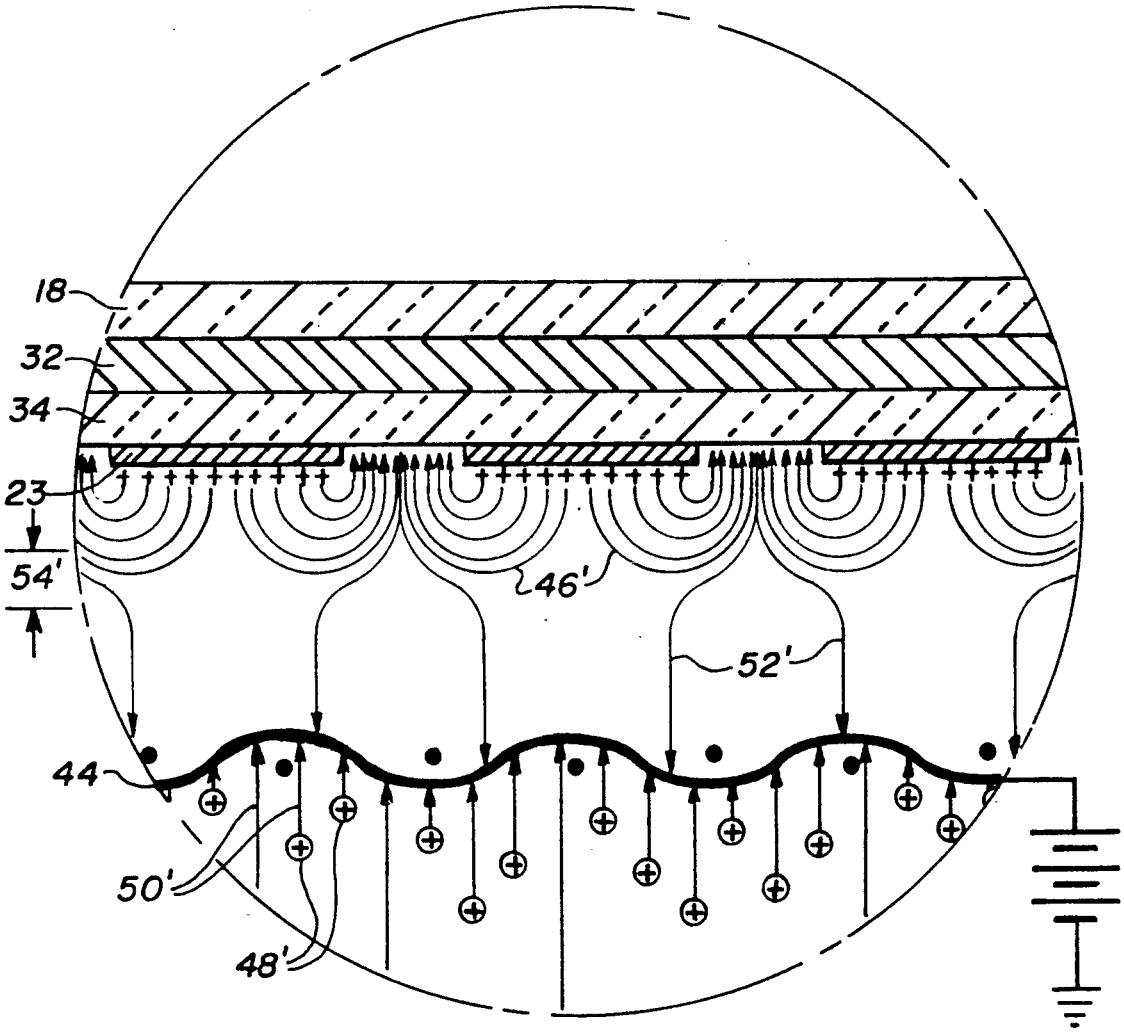
FIG. 7 shows portions of the CRT faceplate and the novel grid-developing electrode, which are within the circle A of FIG. 3*d*, during a phosphor developing step in the screen manufacturing process.

The positively-charged green-emitting phosphor particles are expelled from the developer, repelled by the positively-charged areas of the photoconductive layer 34 and matrix 23, and deposited onto the discharged, light-exposed areas of the photoconductive layer 34, in a process known as reversal developing. As shown in FIG. 7, the expulsion of a substantial quantity of positively-charged green-emitting phosphor particles 48, into the volume adjacent to the grid-developing electrode 44 creates a separate, nearly uniform, normal electric space charge field component 50' outside the grid-developing electrode 44. This space-charge field component 50' is directed toward the photoconductive layer 34 and acts to propel the positively charged, green-emitting phosphor particles 48' through the opposing drag forces of the ambient air to the vicinity of the photoconductive layer 34. The magnitude of the space-charge field may range from a few tenths of a kV/cm to several kV/cm, and is governed by the geometry of the developer and the physical properties of the positively-charged, green-emitting phosphor particles. In particular, the space-charge field strength is proportional to the flow rate with which the positively-charged, green-emitting phosphor particles 48' leave the developer 42, and it is substantially independent of potentials in the approximate range of zero to +2000 volts that might be applied to the grid-developing electrode 44. The grid-developing electrode 44 is positively biased to a voltage in the range of +200 to +1600 volts, depending on the spacing between the electrode 44 and the photoconductive layer 34. The closer the spacing, the lower the voltage required to establish the desired substantially uniform electric field 52' between the electrode 44 and the photoconductor layer 34. The strength of this field 52, establishes the desired velocity of the phosphor particles as they approach the previously described electric field transition zone 54', which lies typically less than about 1 mm from the surface of the photoconductor layer 34. In the absence of a grid-developing electrode, the propelling effect of the space-charge field from the body of positively-charged phosphor particles expelled by the developer 42 may be strong enough to substantially reduce the repelling effect of the latent image field in the exposed region of the photoconductive layer 34. The resultant normal component of the latent image field near the surface of the photoconductive layer 34 may not be effective to repel the positively-charged, green-emitting phosphor particles, in reversal development, from the areas of the photoconductive layer that should be free of green phosphor. Accordingly, cross-contamination occurs, unless the grid-developing electrode 44 is utilized during phosphor development.

The positive potential applied to the grid-developing electrode 44 is adjusted according to the desired flow rate of phosphor material from the developer 42, and according to such physical properties as size, mass density, and charge of the green-emitting phosphor particles, in order to minimize the deposition of particles in undesired locations. The potential applied to the grid-developing electrode 44 should be more positive than the spatial average of the potential from the latent image, in order that the substantially uniform field 52' outside the transition zone 54' attracts the positively-charged phosphor particles 48' to the photoconductive layer 34. If the field 52' established by the grid-developing electrode 44 is weaker than the field 50' from the body of space charge, the grid field cannot support a material flow rate as high as the rate at which phosphor particles 48' are expelled by the developer 42. Consequently, the grid-developing electrode 44 will collect a fraction of the positively-charged phosphor particles, while the remaining fraction continues toward the photoconductive layer 34 at a lower flow rate commensurate with the reduced field intensity between the grid-developing electrode 44 and the photoconductive layer 34. Conversely, if the field 52' between the grid-developing electrode 44 and the photoconductive layer 34 is equal to or stronger than the field 50' of the space charge, few positively-charged phosphor particles will be collected by the grid-developing electrode 44. The particles 48' will, instead, pass through the openings of the grid-developing electrode 44 and be accelerated to the new flow velocity associated with the higher field 52'. The phosphor particles 48', thus, are propelled through the transition zone 54' and attracted to the discharged, exposed areas of the photoconductive layer 34. The deposited green-emitting phosphor particles are fixed to the photoconductive layer as described below.

The photoconductive layer 34, matrix 23 and green phosphor layer (not shown) are uniformly recharged to a positive potential of about 200 to 700 volts for the application of the blue-emitting phosphor particles of screen structure material. The shadow mask is reinserted into the panel 12 and selective areas of the photoconductive layer 34 are exposed to visible light from a second position within the lighthouse 40, which approximates the incidence angle of the blue phosphor-impinging electron beam, to selectively discharge the exposed areas. The shadow mask 25 is removed from the panel 12 and the panel is moved to a third developer 42 containing suitably prepared dry-powdered particles of blue-emitting phosphor. The phosphor particles are surface-treated, as described above, with a suitable charge controlling material to provide a positive charge on the phosphor particles. The dry-powdered, triboelectrically-positively-charged, blue-emitting, phosphor particles are expelled from the third developer 42; propelled to the transition zone 54' by the controlled, substantially uniform field 52' of the biased grid-developing electrode 44; repelled from the positively-charged areas of the photoconductive layer 34, the matrix 23 and the green phosphor material; and deposited onto the discharged, light-exposed areas of the photoconductive layer. The deposited blue-emitting phosphor particles may be fixed to the photoconductive layer, as described below.

The processes of charging, exposing, developing and fixing are repeated again for the dry-powdered, red-emitting, surface-treated phosphor particles. The exposure to visible light, to selectively discharge the positively-charged areas of the photoconductive layer 34, is from a third position within the lighthouse 40, which approximates the incidence angle of the red phosphor-impinging electron beam. The dry-powdered, triboelectrically-positively-charged, red-emitting phosphor particles are expelled from a fourth developer 42; propelled to the transition zone 54' by the controlled, substantially uniform field 52' of the grid-developing electrode 44; repelled from the positively-charged areas of the previously deposited screen structure materials; and deposited onto the discharged areas of the photoconductive layer 34.

The phosphors may be fixed by exposing each successive deposition of phosphor material to infrared radiation which melts or thermally bonds the polymer component to the photoconductive layer 34. Subsequent to the fixing of the red-emitting phosphor material, the screen structure material is filmed and then aluminized, as is known in the art.

The faceplate panel 12 is baked in air, at a temperature of 425° C. for about 30 minutes, to drive off the volatilizable constituents of the screen, including the conductive layer 32 and the photoconductive layer 34, the solvents present in both the screen structure materials and in the filming material. The resultant screen assembly may possess higher resolution (as small as 0.1 mm line width obtained using a resolution target), higher light output than a conventional wet processed screen, and greater color purity because of the reduced cross-contamination of the phosphor materials.

GENERAL CONSIDERATIONS

In prior applications of electrophotography to office copying machines (see, e.g., U.S. Pat. No. 2,784,109, issued to Walkup on Mar. 5, 1957), a developing electrode is used. The use is to eliminate the edge-enhancement effects encountered in the development of uniformly charged, i.e., unexposed or partially exposed, areas that are substantially larger than the width of the line strokes in typical printed lettering, which are typically of the order of 0.5 to 1.0 mm. In these applications, the electrode is spaced substantially closer to the photoreceptive layer than the diameter of the area to be uniformly developed, i.e., the unexposed areas, and the applied potential is large enough to significantly straighten the curving electric field lines near the edges of the charged image areas. Such an electrode is not required for developing small dark areas such as lines, letters, characters and the like, which have a size comparable to the smallest dimension of the phosphor and matrix lines of a CRT screen. In contrast to this usage, the grid-developing electrode 44 used for electrophotographically manufacturing the screen assembly of a color CRT in the present invention is structurally and functionally different from the electrode used in a copy machine. The novel grid electrode 44 is placed at a distance (typically 0.5 to 4.0 cm) from the photoconductive layer 34 that is relatively large compared to, e.g., equal to or greater than six times, the characteristic size of the smallest dimension of the unexposed latent image areas (approximately 0.75 mm for phosphor, and 0.25 mm for matrix) and lies outside the effective range of the spatially varying latent image field (46 and 46'). Furthermore, the magnitude of the potential applied to the grid electrode 44 is purposely restricted to a range of values which produce little distortion of the highly localized latent image field, so that intensification and straightening of the field lines does not occur.

The novel grid-developing electrode 44 provides a more uniform deposition of phosphor without cross-contamination, than is possible in dry-powder processes without such an electrode. The electrode also provides means for tailoring the amount of phosphor deposited on different areas of the faceplate, analogous to the conventional slurry screening process where screen weight variations are achieved by controlling slurry thickness and the light intensity distribution of the lighthouse. In the present process, screen weight is controlled by the bias potential applied to the grid-developing electrode 44 and the distance between the electrode 44 and the photoconductive layer 34 on the faceplate 18. The grid-developing electrode is generally contoured to conform to the curvature of the faceplate; however, it can be tailored to compensate for non-uniformities in the phosphor developing apparatus or to achieve a desired non-uniformity in phosphor screen weight. Additionally, the apparatus and process described herein may be utilized to screen a variety of tube sizes on the same developer with only a change in the size of the grid-developing electrode.

What is claimed is:

1. In a method of electrophotographically manufacturing a luminescent screen assembly on a substrate, for use within a CRT, including the steps of:

a) coating said substrate with a conductive layer;

b) overcoating said conductive layer with a photoconductive layer;

c) establishing an electrostatic charge on said photoconductive layer;

d) exposing selected areas of said photoconductive layer to visible light to affect the charge thereon and to establish a latent image having exposed and unexposed areas, said latent image producing a latent image field adjacent to the photoconductive layer; and e) developing said photoconductive layer with dry-powdered, triboelectrically charged, screen structure materials having a surface charge control agent thereon to control the triboelectrical charging thereof, the improvement wherein developing includes the steps of:

i) locating a grid-developing electrode, having a plurality of openings therethrough, at a distance from said photoconductive layer that is large relative to the smallest dimension of the largest image detail of interest of said unexposed lateral image areas, the smallest dimension of the largest image detail of interest being within the range of about 0.1 to 0.9 mm, said grid-developing electrode being located beyond the range of said latent image field, so that the field created by said grid-developing electrode does not substantially affect said latent image field; and ii) electrically biasing said grid-developing electrode with a suitable potential to influence the deposition of said charged screen structure materials onto predetermined areas of said charged photoconductive later without contaminating adjacent areas, said potential on said grid-developing electrode being of the same electrical polarity as the triboelectric charge on said screen structure materials.

2. In a method of electrophotographically manufacturing a luminescent screen assembly on a substrate, for use with a CRT, including the steps of:

a) coating said substrate with a conductive layer;

b) overcoating said conductive layer with a photoconductive layer;

c) establishing a positive electrostatic charge on said photoconductive layer;

d) exposing selected areas of said photoconductive layer to visible light to discharge the charge thereon and to establish a latent image having exposed and unexposed areas, said latent image producing a latent image field adjacent to the photoconductive layer; and e) direct developing of said unexposed, positively-charged areas of said photoconductive layer with dry-powdered, triboelectrically negatively-charged, matrix particles, the improvement wherein direct developing includes the steps of:

i) locating a grid-developing electrode, having a plurality of openings therethrough, at a distance of about 0.5 to 4.0 cm from said photoconductive layer, said distance being large relative to the smallest dimension of the largest image detail of interest of said unexposed latent image areas, the smallest dimension of the largest image detail of interest being within the range of 0.1 to 0.3 mm, said grid-developing electrode being located beyond the range of said latent image field, so that the field created by said grid-developing electrode does not substantially affect said latent image field; and ii) electrically biasing said grid-developing electrode with a suitable negative potential to influence the deposition of said negatively-charged, matrix particles onto only said positively-charged, unexposed areas of said photoconductive layer.

3. In a method of electrophotographically manufacturing a luminescent screen assembly on a substrate, for use within a CRT, including the steps of:

a) coating said substrate with a conductive layer;

b) overcoating said conductive layer with a photoconductive layer;

c) establishing a positive electrostatic charge on said photoconductive layer;

d) exposing selected areas of said photoconductive layer to visible light, to discharge the positive charge thereon and to establish a latent image having exposed and unexposed areas, said latent image producing a latent image field adjacent to said photoconductive layer; and e) reversal developing of said exposed, discharged areas of said photoconductive layer with dry-powdered, triboelectrically positively-charged phosphor screen structure materials having a surface charge control agent thereon to control the triboelectrical charging thereof, the improvement wherein reversal developing includes the steps of:

i) locating a grid-developing electrode, having a plurality of openings therethrough, at a distance of about 0.5 to 4.0 cm from said photoconductive layer, said distance being large relative to the smallest dimensions of the largest image detail of interest of said unexposed latent image areas, the smallest dimension of the largest image detail of interest being within the range of 0.3 to 0.9 mm, said grid developing electrode being located beyond the range of said latent image field, so that the field created by said grid-developing electrode does not substantially affect said latent image field; and ii) electrically biasing said grid-developing electrode with a suitable positive voltage to influence the deposition of said positively-charged, phosphor screen structure materials onto only said discharged, exposed areas of said photoconductive layer.

* * * * *

UNITED STATES PATENT AND TRADEMARK OFFICE

CERTIFICATE OF CORRECTION

PATENT NO. : 5,093,217

DATED : March 3, 1992

INVENTOR(S) : Pabitra Datta et al.

It is certified that error appears in the above-identified patent and that said Letters Patent is hereby corrected as shown below:

Col. 1, line 46, after "color-emissive", delete "phosphors".

Col. 2, line 33, after "developing" add --step in the screen manufacturing process--.

Col. 3, line 14, after "screen" add --,--.

Col. 7, line 8, change "46,," to --46',--.

Col. 9, line 3, after "volts" add --,--.

UNITED STATES PATENT AND TRADEMARK OFFICE

CERTIFICATE OF CORRECTION

PATENT NO. : 5,093,217

DATED : March 3, 1992

INVENTOR(S) : Pabitra Datta et al.

It is certified that error appears in the above-identified patent and that said Letters Patent is hereby corrected as shown below:

Col. 9, line 55, after "32"
add --,-- and after "34" change
"," to --and--.

Claim 1, column 11, line 25,
change "later" to --layer--.

Signed and Sealed this

Twenty-fourth Day of August, 1993

Bruce Lehman

*Attest:*

BRUCE LEHMAN

*Attesting Officer*

*Commissioner of Patents and Trademarks*